US010724184B2

(12) United States Patent
Hwang

(10) Patent No.: US 10,724,184 B2
(45) Date of Patent: Jul. 28, 2020

(54) CURB BLOCK

(71) Applicant: C&C INC., Wonju-si, Gangwon-do (KR)

(72) Inventor: Yoondal Hwang, Wonju-si (KR)

(73) Assignee: C&C INC., Wonju-si, Gangwon-Do (KR)

( * ) Notice: Subject to any disclaimer, the term of this patent is extended or adjusted under 35 U.S.C. 154(b) by 58 days.

(21) Appl. No.: 16/035,880

(22) Filed: Jul. 16, 2018

(65) Prior Publication Data

US 2019/0024323 A1 Jan. 24, 2019

(30) Foreign Application Priority Data

Jul. 18, 2017 (KR) ..... 10-2017-0090757

(51) Int. Cl.
*E01C 11/22* (2006.01)

(52) U.S. Cl.
CPC ..... *E01C 11/222* (2013.01)

(58) Field of Classification Search
CPC ..... E01C 11/222; E01F 9/535; E01F 9/541; E01F 15/088
USPC ..... 404/7; D12/217
See application file for complete search history.

(56) References Cited

U.S. PATENT DOCUMENTS 687,789 A * 12/1901 Rhynedance ..... E06B 3/9845 403/294
867,388 A * 10/1907 Lerch ..... E01C 11/222 404/7
1,414,593 A * 5/1922 Sklenka ..... A01G 9/20 47/19.1
1,707,574 A * 4/1929 Rothmann ..... E01C 11/223 404/2
2,011,531 A * 8/1935 Tranchell ..... E01C 5/04 405/286
2,282,559 A * 5/1942 Byers ..... H02G 9/025 52/582.1
2,509,669 A * 5/1950 Borst ..... F16B 5/006 403/294

(Continued)

FOREIGN PATENT DOCUMENTS

CA 2215858 A1 * 3/1999 ..... E01C 11/222
DE 3012681 A1 * 10/1981 ..... E01F 15/083

(Continued)

*Primary Examiner* — Thomas B Will
*Assistant Examiner* — Katherine J Chu
(74) *Attorney, Agent, or Firm* — Kile Park Reed & Houtteman PLLC

(57) ABSTRACT

A curb block system includes a main curb block and a male tubular block. The main curb block includes: a body case formed through injection molding of a plastic material, having an open bottom, and including a plurality of vertical partition walls arranged therein to form a plurality of empty compartments; semicircular female slots vertically formed at opposite ends of an upper surface of the body case to face other main curb blocks adjacent thereto, respectively, and the male tubular block is inserted into and coupled to adjacent female slots of a pair of adjacent main curb blocks, has a thickness smaller than the width of the female slot such that an array of the adjacent main curb blocks can be two-dimensionally curved at a predetermined angle in a horizontal plane.

1 Claim, 8 Drawing Sheets

(56) References Cited

U.S. PATENT DOCUMENTS 3,087,279 A * 4/1963 Thompson ..... A01G 9/28 47/33
3,636,829 A * 1/1972 Palmer ..... E01F 9/588 404/7
3,663,808 A * 5/1972 Baatz ..... F21V 33/006 362/152
3,762,113 A * 10/1973 O'Mullan ..... E01C 11/222 52/102
3,937,585 A * 2/1976 Cattermole ..... F16B 3/00 403/300
3,945,747 A * 3/1976 Cruz ..... E01F 15/025 404/7
4,681,302 A * 7/1987 Thompson ..... E01F 8/0035 256/13.1
4,774,733 A * 10/1988 Akers ..... A47C 27/085 403/294
4,780,020 A * 10/1988 Terio ..... E01F 13/048 404/6
5,261,760 A * 11/1993 Castonguay ..... E01C 11/221 404/7
5,445,362 A * 8/1995 Reppert ..... A01G 9/28 256/24
5,464,306 A * 11/1995 Cristiano ..... E01F 15/083 256/13.1
5,882,140 A * 3/1999 Yodock, Jr. ..... E01F 15/083 256/13.1
6,102,374 A * 8/2000 Macri ..... A01G 9/28 256/24
7,407,341 B2 * 8/2008 Yodock, Jr. ..... B63G 9/00 405/63
7,416,364 B2 * 8/2008 Yodock, III ..... E01F 15/083 256/13.1
7,654,768 B1 * 2/2010 Tullis ..... E01F 13/12 256/13.1
D694,431 S * 11/2013 Burnquist ..... D25/113
8,726,815 B2 * 5/2014 Giampavolo ..... B65D 19/38 108/193
D729,415 S * 5/2015 Burnquist ..... D25/113
10,370,806 B1 * 8/2019 Robbins ..... E01F 9/541
2006/0127174 A1 * 6/2006 Linde ..... A63H 18/02 404/7
2008/0145144 A1 * 6/2008 Desrosiers ..... E01C 11/222 404/7
2009/0208286 A1 * 8/2009 Sutton ..... E01C 11/223 404/7
2010/0111602 A1 * 5/2010 Yodock, III ..... E01F 15/083 404/6

FOREIGN PATENT DOCUMENTS

DE 102008045518 A1 * 3/2010 ..... E01F 15/083
KR 1991-0015756 9/1991
KR 1995-0004902 6/1995
WO WO-2018169197 A1 * 9/2018 ..... A61H 3/06

* cited by examiner

CURB BLOCK

FIELD OF THE INVENTION

The present invention relates to a curb block and, more particularly, to a curb block, which is formed of a light-weight plastic material and can be connected in a straight line, in a curved line, or in an inclined manner after being embedded in the ground.

DESCRIPTION OF THE RELATED ART

A curb is a facility that separates a sidewalk from a roadway, guides traffic flow, and protects pedestrians from car accidents.

Generally, such a curb is formed of natural granite stones, causing deterioration in constructability and increase in construction costs.

In order to solve such problems, a road safety block is disclosed in Korean Patent Publication No. 1991-0015756 filed by the present inventors.

The road safety block includes: a main body injection-molded with a plastic material and having a trapezoidal shape in cross-section; a male portion formed at one side of the main body; a female portion formed on the other side of the main body; and a grid stiffener disposed in the main body to form a plurality of compartments, wherein a bottom of the main body is open to expose the plurality of compartments.

In construction of the road safety block, first, an appropriate amount of mortar is applied to a concrete floor at the border between a pavement and a roadway to a thickness at which a lower portion of the grid stiffener can be buried in the mortar. Then, the main body is placed on the mortar and pushed downward such that the mortar flows into the plurality of compartments and the lower portion of the grid stiffener is buried in the mortar with a space above the mortar remaining empty. Then, as the mortar is hardened over time, the main body is firmly attached to the concrete floor, such that construction of the road safety block is completed.

Advantageously, use of the grid stiffener allows the road safety block to have a large inner space and thus light weight, while providing robustness to the road safety block.

However, since the road safety blocks are serially arranged along a straight line without any separate coupling means therebetween, the road safety blocks can be easily disconnected or dislocated by external force.

In order to solve such a problem, Korean Utility Model Publication No. 20-1995-0004902 filed by the present inventors discloses a road safety block which includes a female portion formed at one side thereof and a male portion at the other side thereof, wherein the female portion is adapted to be coupled to the male portion. However, such road safety blocks cannot be serially arranged in a curved line or in an inclined manner.

SUMMARY OF THE INVENTION

The present invention has been conceived to solve such a problem in the art.

In accordance with one aspect of the present invention, a curb block includes; a main curb block; and a male tubular block, wherein the main curb block includes: a body case formed through injection molding of a plastic material, having an open bottom, and including a plurality of vertical partition walls arranged therein to form a plurality of empty compartments; semicircular female slots vertically formed at opposite ends of an upper surface of the body case to face other main curb blocks adjacent thereto, respectively, and the male tubular block is inserted into and coupled to adjacent female slots of a pair of adjacent main curb blocks, and has a thickness smaller than the width of the female slot, such that an array of the adjacent main curb blocks can be two-dimensionally curved at a predetermined angle in a horizontal plane.

The curb block may further include an auxiliary curb block. The auxiliary curb block includes: an auxiliary body case formed through injection molding of a plastic material and including an inner arc wall, an outer arc wall, and vertical side walls, the inner arc wall having a first curvature, the outer arc wall having a curvature greater than the first curvature, the inner arc wall and the outer arc wall having the same center of curvature and being spaced apart from each other by a distance between inner and outer walls of the main curb block, and the vertical side walls having a shape converging on the center of curvature to integrally connect both ends of the inner arc wall to both ends of the outer arc wall, respectively; and semicircular auxiliary female slots vertically formed at opposite sides of an upper surface of the auxiliary body case to face other main curb blocks adjacent thereto and adapted to be coupled to the male tubular block, whereby an array of the main curb blocks can be two-dimensionally curved at an angle greater than the predetermined angle in a horizontal plane.

The curb block may further include a slanted curb block. The slanted curb block includes female slots formed at opposite ends thereof, wherein the female slots are identical to the female slots of the main curb block, and a portion of the slanted curb block between the female slots is generally inclined downward, whereby an array of the main curb blocks can be inclined in the horizontal plane.

The present invention provides a curb block which is manufactured through injection molding of a typical plastic material and can be arranged in a straight line, in a curved line, or in an inclined manner while being connected to one another through male-female coupling. In addition, a cut curb block can also be connected to an uncut curb block through male-female coupling.

DETAILED DESCRIPTION OF THE INVENTION

Figure 1:
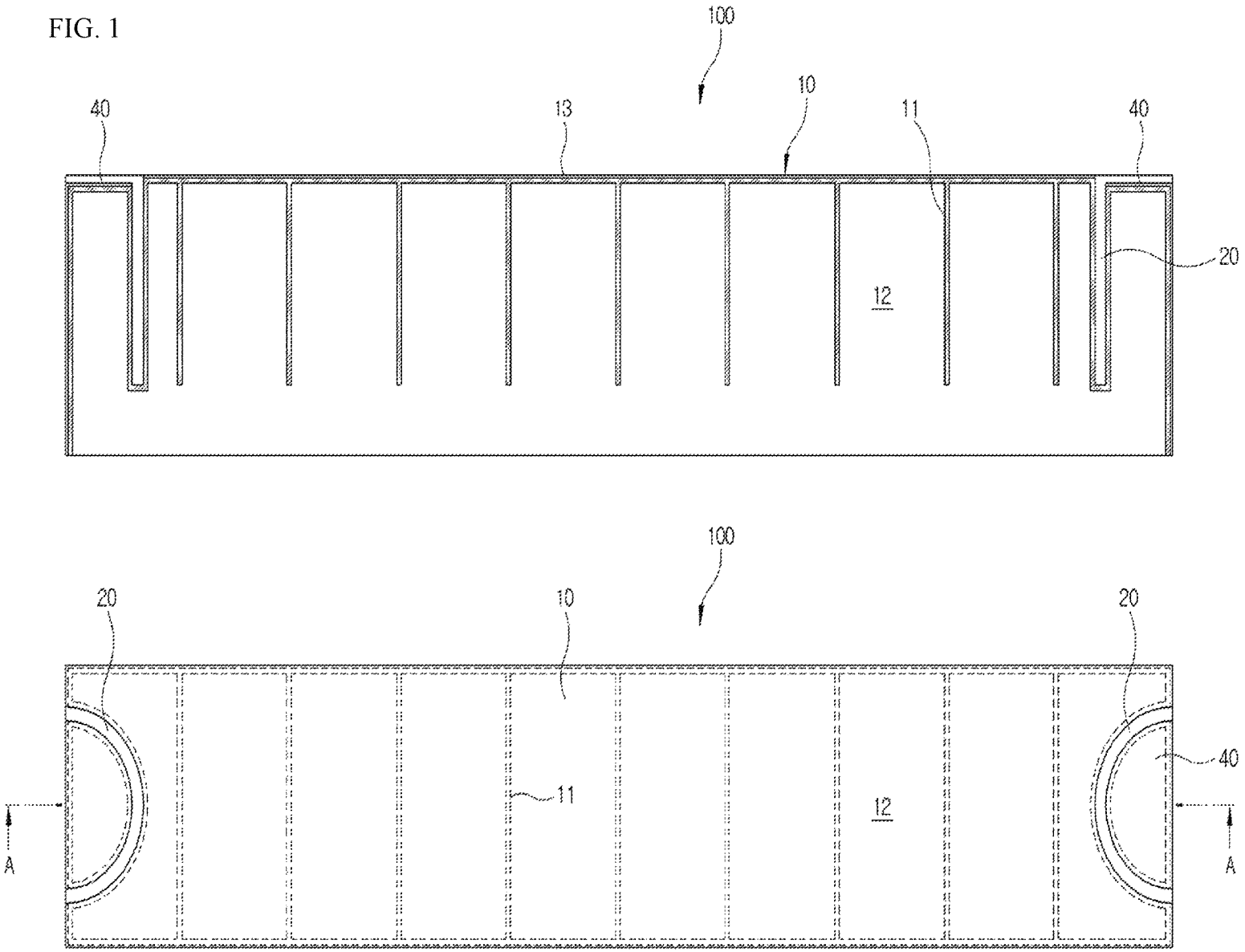
FIG. 1 shows a plan view and a sectional view of a main curb block according to one embodiment of the present invention.

Hereinafter, embodiments of the present invention will be described in detail with reference to FIG. 1 to FIG. 8.

A curb block according to one embodiment of the present invention includes a main curb block 100, a male tubular block 30, and, optionally, at least one of an auxiliary curb block 200, a slanted curb block 300, and a finish curb block 400.

In FIG. 1, a main curb block according to one embodiment of the present invention is designated by reference numeral 100.

Referring to FIG. 1, the main curb block 100 includes: a hexahedral body case 10 formed through injection molding of a plastic material, having an open bottom, including a plurality of vertical partition walls 11 arranged at predetermined intervals in a longitudinal direction of the body case 10 inside the body case 10 to form a plurality of compartments 12; stepped portions 40 formed at opposite ends of an upper surface 13 of the body case 10, respectively, and having a smaller height than the upper surface and semicircular female slots 20 vertically formed between the upper surface 13 and the stepped portions 40 to face in opposite directions.

The male tubular block 30 is formed through injection molding of a plastic material, has a closed top and an open bottom, and is sized and shaped to be coupled to adjacent female slots 20 of a pair of adjacent main curb blocks 100.

The thickness of a circumferential portion of the male tubular block 30 is smaller than the width of the female slot 20 such that an array of adjacent main curb blocks 100 can be two-dimensionally curved at a predetermined angle in a horizontal plane.

In addition, the thickness of a ceiling 31 of the male tubular block 30 corresponds to a height difference between the stepped portion 40 and the upper surface 13 such that the upper surface of the main curb block 100 is flush with an upper surface of the male tubular block 30 when the male tubular block 30 is coupled to the female slot 20, whereby the upper surface of the main curb block 100 can be flat overall.

Further, the plurality of vertical partition walls 11 is coupled at an upper end to the ceiling of the body case 10, extends at a lower end thereof to above a lower end of the body case 10, is integrally coupled at both sides thereof to front and rear walls of the body case 10, respectively.

Figure 2:
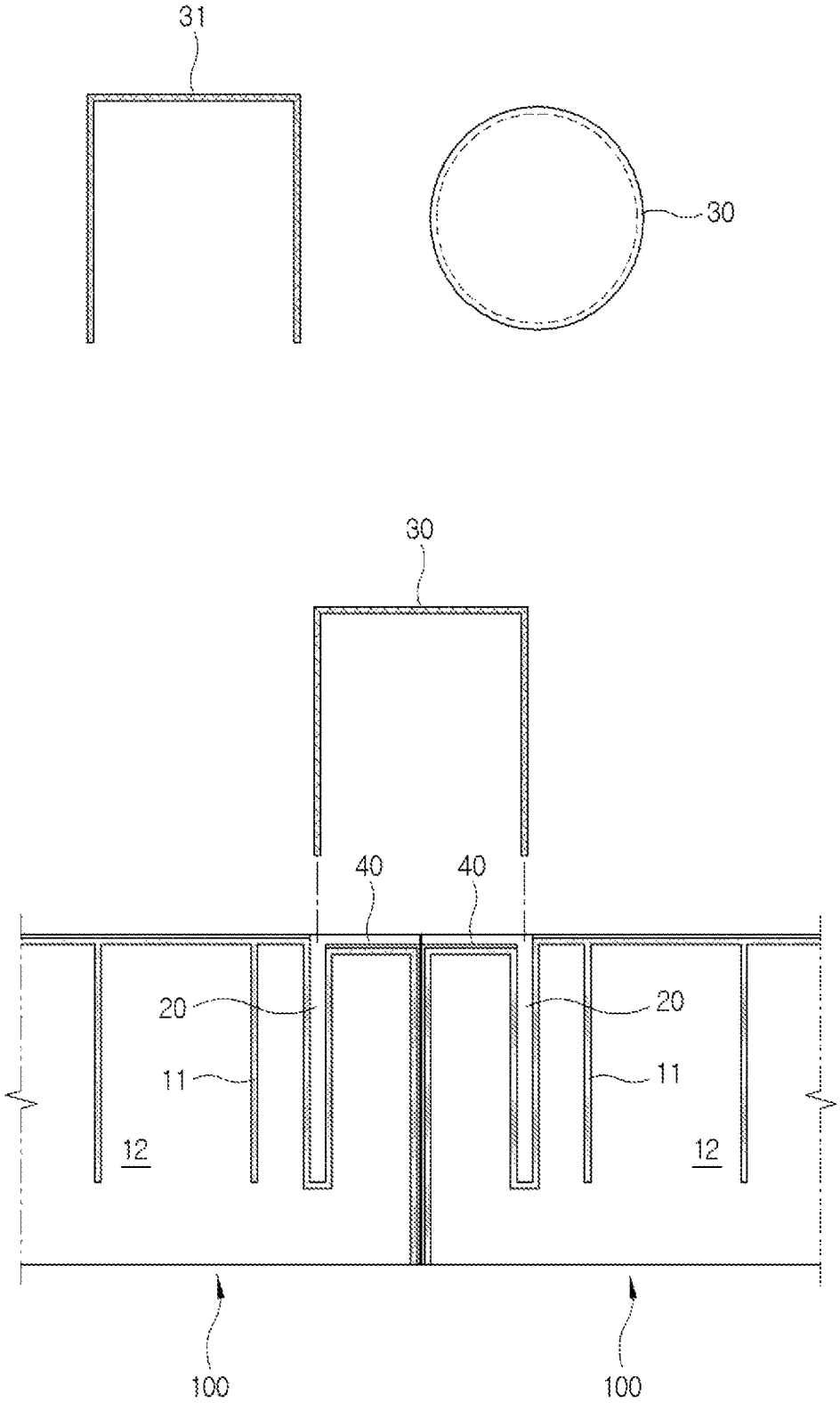
FIG. 2 is a plan view illustrating connection between two main curb blocks as shown in FIG. 1 through a male tubular block.

In order to arrange the main curb blocks 100 in a straight line in a horizontal plane, as shown in FIG. 2, first, the main curb blocks 100 are placed at a place with uncured mortar applied thereto such that a side wall of one main curb block abuts a side wall of another main curb block. Then, one male tubular block 30 is inserted into adjacent female slots 20 of the pair of adjacent main curb blocks 100 and then is pushed downward together with the pair of adjacent main curb blocks 100 such that the lower end of the body case 10 and the lower end of the plurality of vertical partition walls 11 are inserted into the mortar layer, as in the related art. Then, the mortar layer is cured, thereby completing construction of the curb block. Further, in order to arrange the main curb blocks 100 so as to be slightly curved in the horizontal plane, first, the main curb blocks 100 are placed at a place with uncured mortar applied thereto such that a side wall of one main curb block is slightly separated from a side wall of another main curb block. Then, one male tubular block 30 is inserted into adjacent female slots 20 of the pair of adjacent main curb blocks 100 while slightly pivoting one of the adjacent main curb blocks 100 around the male tubular block 30. Then, the male tubular block 30 is pushed downward together with the adjacent main curb blocks 100 such that the lower end of the body case 10 and the lower end of the plurality of vertical partition walls 11 are inserted into the mortar layer, as in the related art. Then, the mortar layer is cured, thereby completing construction of the curb block.

Figure 3:
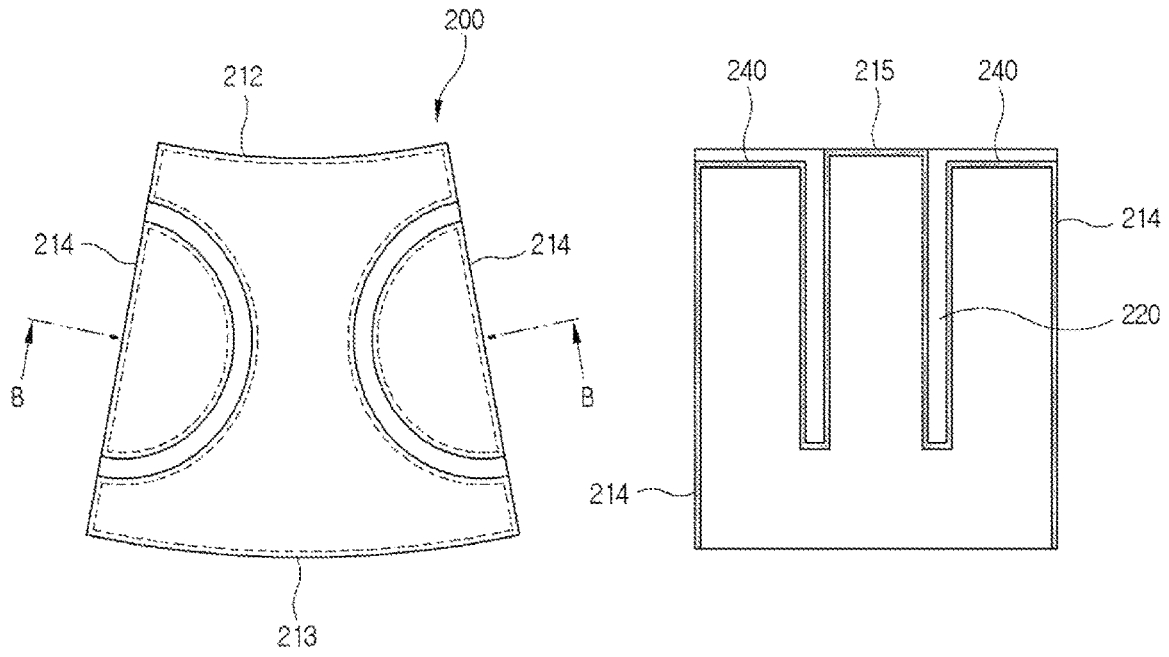
FIG. 3 shows a plan view and sectional view of an auxiliary curb block interposed between the main curb blocks of FIG. 1.

In FIG. 3, an auxiliary curb block adapted to abut the main curb block 100 and to be coupled to the male tubular block 30 together with the main curb block 100 is designated by reference numeral 200.

Referring to FIG. 3, the auxiliary curb block 200 includes: an auxiliary body case 210 formed through injection molding of a plastic material, having an open bottom, and including an inner arc wall 212, an outer arc wall 213, and vertical side walls 214, wherein the inner arc wall 212 has a first curvature, the outer arc wall 213 has a curvature greater than the first curvature, the inner arc wall 212 and the outer arc wall 213 have the same center of curvature and are spaced by a distance between the inner and outer walls of the main curb block 100, and the vertical side walls 214 have a shape converging on the center of curvature to integrally connect both ends of the inner arc wall 212 to both ends of the outer arc wall 213, respectively; stepped portions 240 formed at opposite ends of an upper surface 215 of the auxiliary body case 210 and having a smaller height than the upper surface 215; and auxiliary semicircular female slots 220 vertically formed between the upper surface 215 and the stepped portions 240 to face in opposite directions, having the same size and shape as the female slots 20 of the main curb block 100, and adapted to be coupled to the male tubular block 30.

Further, a height difference between each of the stepped portions 240 and the upper surface 215 corresponds to the thickness of the ceiling 31 of the male tubular block 30.

Figure 4:
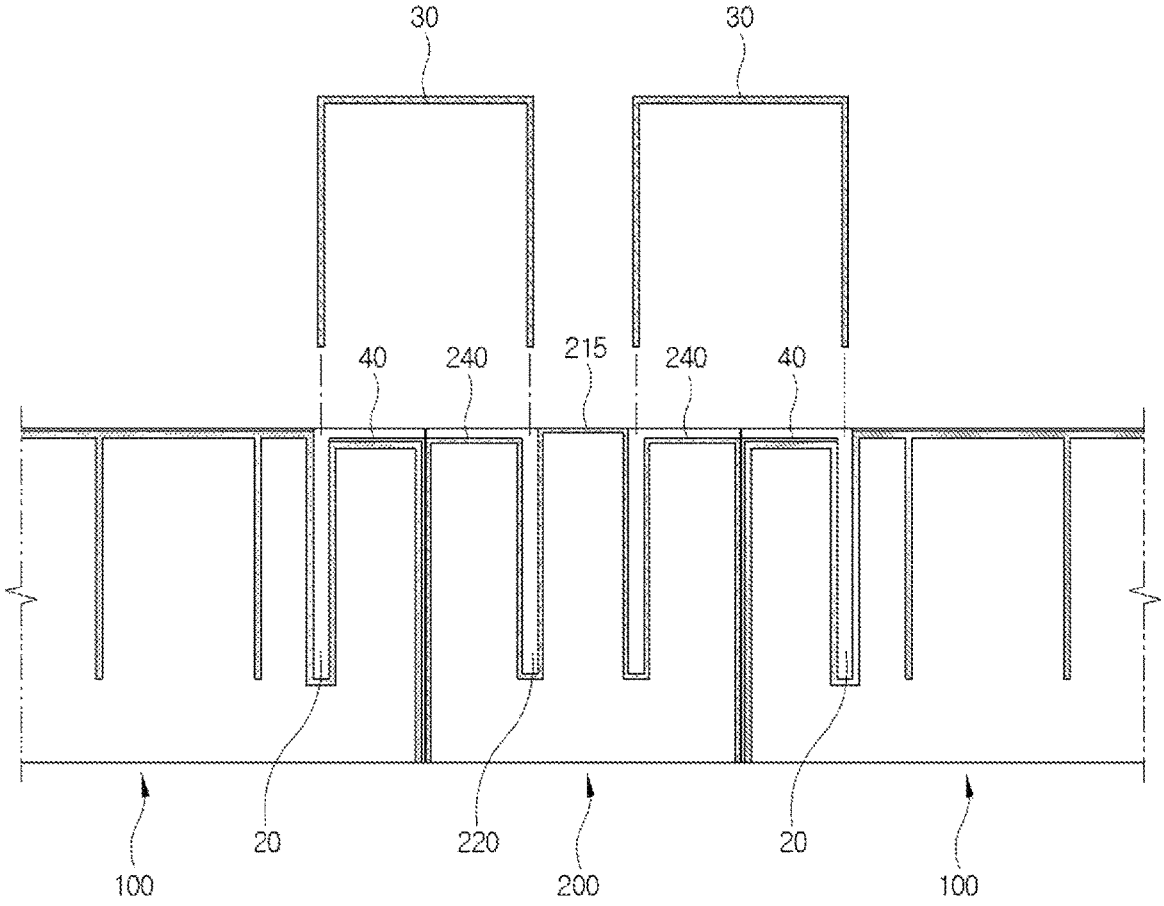
FIG. 4 is a plan view illustrating connection between the main curb block of FIG. 1 and the auxiliary curb block of FIG. 3 through the male tubular block.

Referring to FIG. 4, the auxiliary curb block 200 may be interposed between the main curb blocks 100 arranged curved at an angle greater than the aforementioned predetermined angle. To this end, the side walls 214 of the auxiliary curb block 200 are allowed to abut side walls of the main curb blocks 100, respectively, and then the male tubular block 30 is inserted into and coupled to the auxiliary female slot 220 of the auxiliary curb block 200 and the female slot 20 of each of the adjacent main curb blocks 100, which are adjacent to each other, whereby the main curb blocks can be arranged to be two-dimensionally curved at a greater angle in the horizontal plane.

Figure 5:
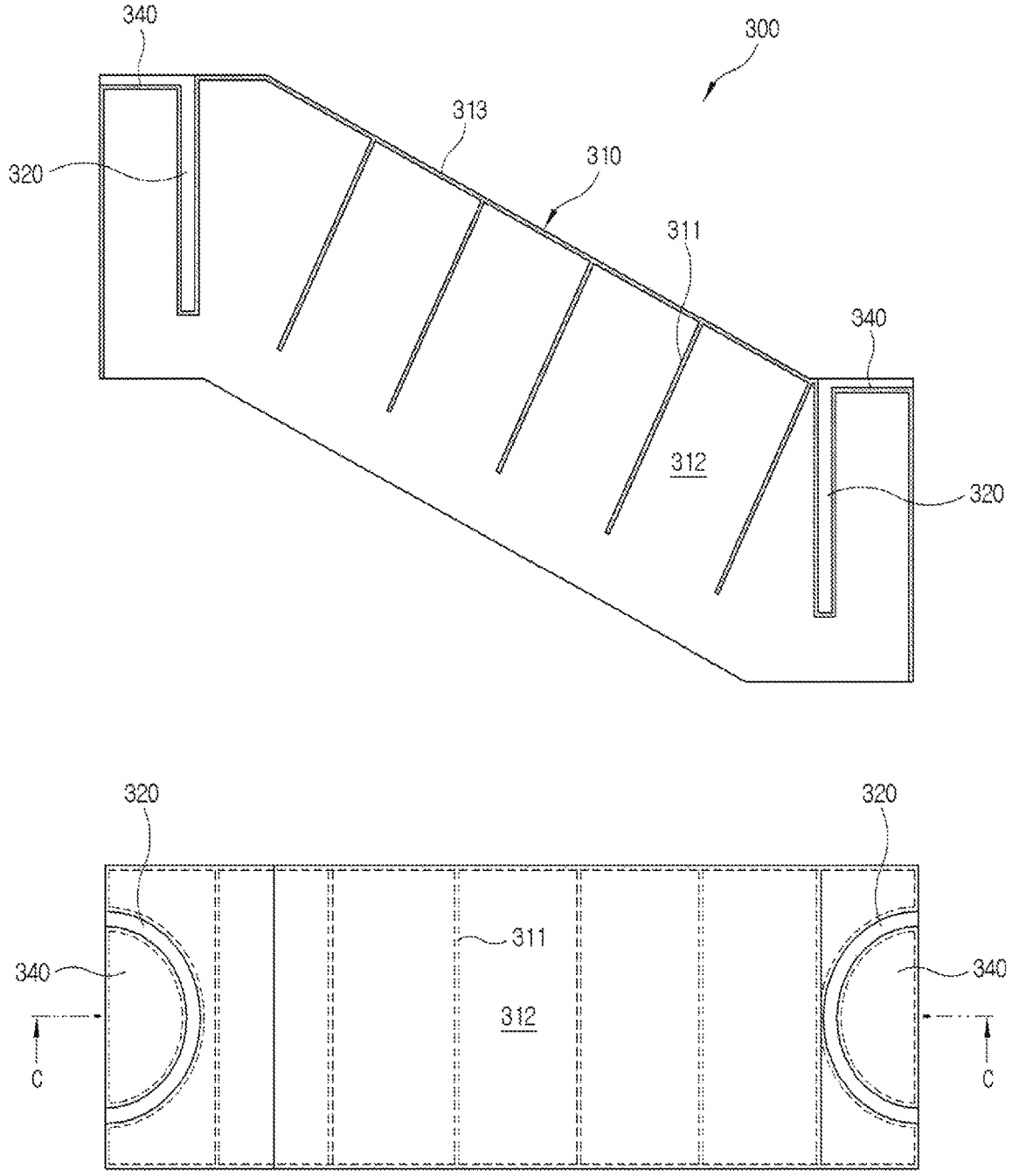
FIG. 5 shows a plan view and a sectional view of a slanted curb block interposed between the main curb blocks of FIG. 1 with a level difference therebetween.

In FIG. 5, a slanted curb block adapted to abut the main curb block 100 and to be coupled to the male tubular block 30 together with the main curb block 100 is designated by reference numeral 300.

Referring to FIG. 5, for the slanted curb block 300, stepped portions 340 and female slots 320 identical to the stepped portions 40 and the female slots 20 of the main curb block 100 are formed at opposite ends of a body case 310; a portion of the body case 310 between the stepped portions 340 is generally inclined downward; and the body case 310 has an open bottom and includes a plurality of partition walls 311 perpendicular to an upper surface 313 of the body case 310, wherein the plurality of partition walls is arranged at predetermined intervals in a longitudinal direction of the body case 310 inside the body case 310 to form a plurality of empty compartments, like the body case 10 of the main curb block 100.

Figure 6:
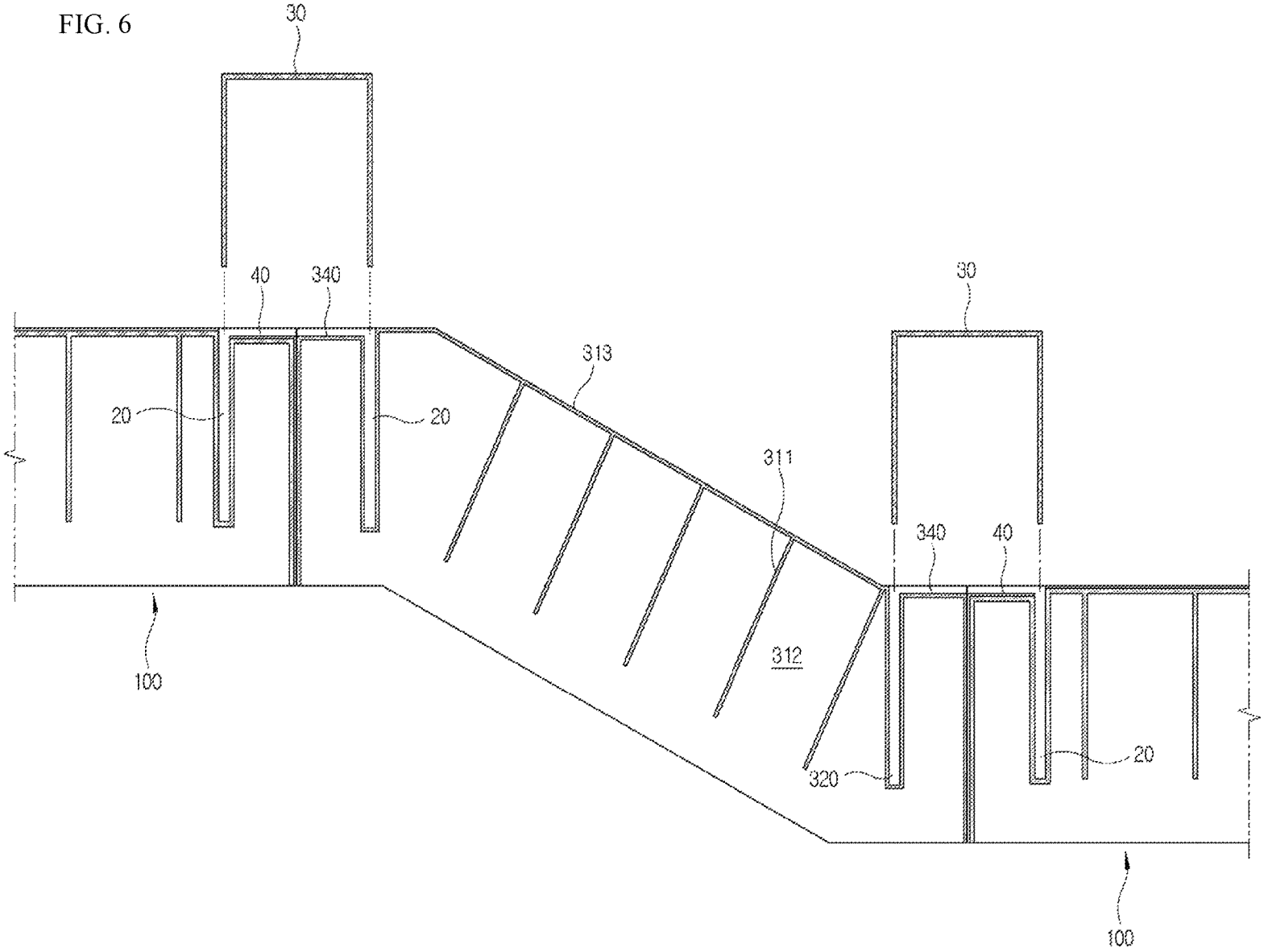
FIG. 6 is a front view illustrating connection between the main curb block of FIG. 1 and the slanted curb block of FIG. 5 through the male tubular block.

Referring to FIG. 6, the slanted curb block 300 may be interposed between the main curb blocks 100 arranged with a level difference therebetween. To this end, the side walls 214 of the slanted curb block 300 are allowed to abut side walls of the main curb blocks 100, respectively, and then the male tubular block 30 is inserted into and coupled to the female slot 320 of the slanted curb block 300 and the female slot 20 of each of the adjacent main curb blocks 100, which are adjacent to each other, whereby the main curb blocks having different height levels can be arranged in an inclined plane while being connected to one another through the male tubular block 30 coupled thereto.

Figure 7:
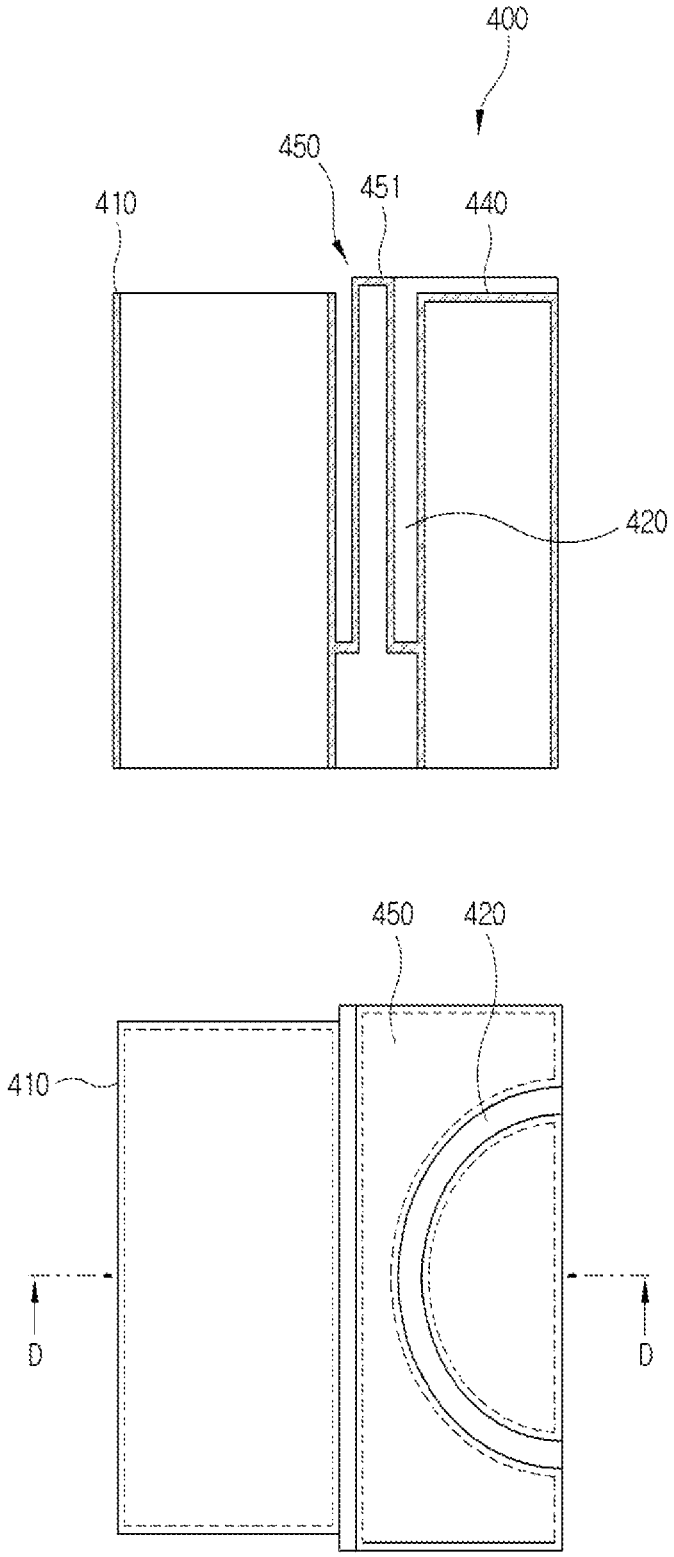
FIG. 7 shows a plan view and a sectional view of a finish curb block coupled to the main curb block of FIG. 1, having been cut.

Referring to FIG. 7, a finish curb block is designated by reference numeral 400. The finish curb block is adapted to be coupled to one main curb block 100 cut short in a connection direction with respect to the finish curb block and placed at one side of the finish curb block and to be coupled to the male tubular block 30 together with the female slot 20 of another main curb block 100 disposed at the other side of the finish curb block.

Referring to FIG. 7, the finish curb block 400 includes: a male portion 410 having the same height as the stepped portions 40 of the main curb block 100 and sized and shaped to be inserted into and coupled to one compartment 12 of the main curb block 100 through the open bottom of the main curb block 100; a stepped portion 440 having the same size and shape as the stepped portions 40 of the main curb block 100; and a reverse U-shaped connection portion 450 integrally coupling the male portion 410 to the stepped portion 440 while allowing a semicircular female slot 420 to be formed between the male portion 410 and the stepped portion 440, wherein the semicircular female slot 420 is identical to the semicircular female slots 20 of the main curb block 100.

Here, an upper surface of the reverse U-shaped connection portion 450 is flush with the upper surface 13 of the main curb block 100.

Figure 8:
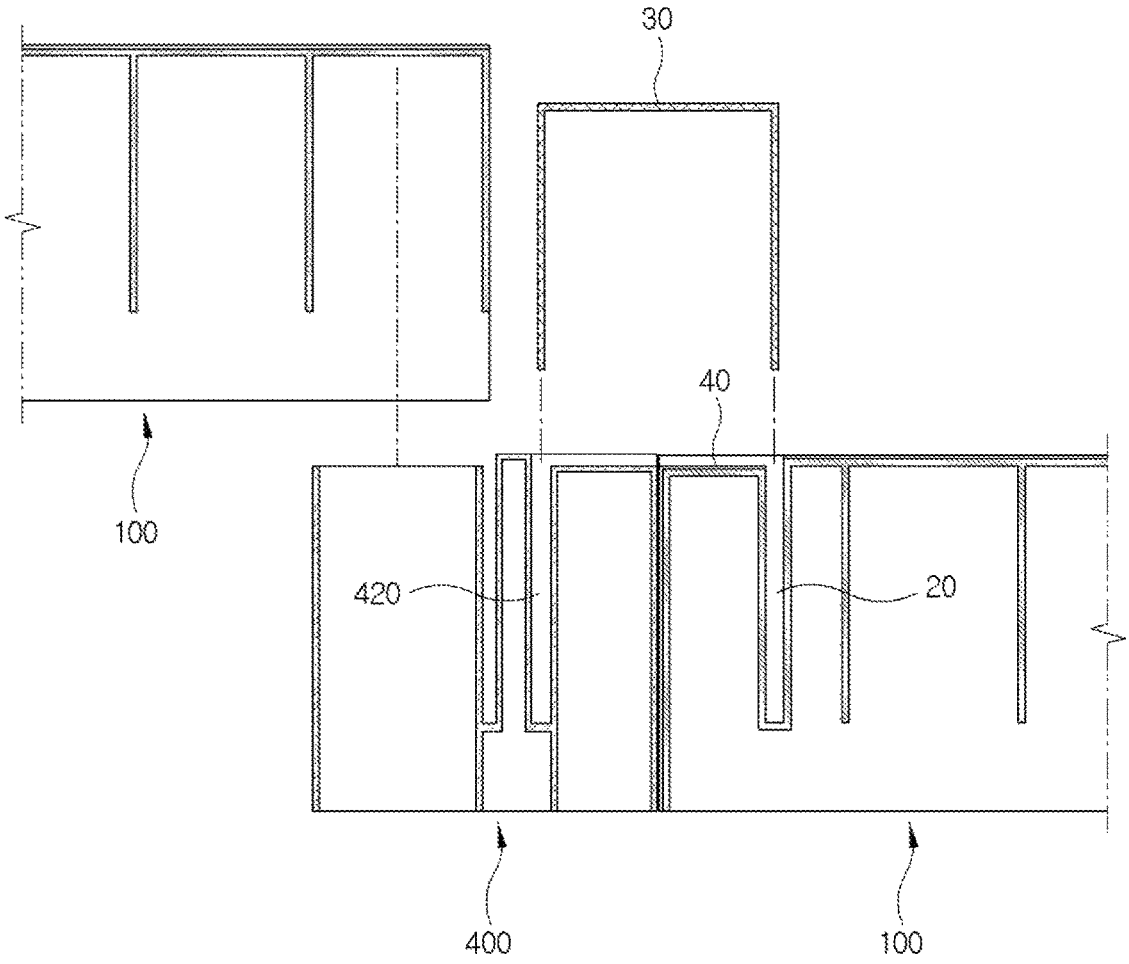
FIG. 8 is a front view illustrating connection between the main curb block of FIG. 1 and the finish curb block of FIG. 7 through the male tubular block.

Referring to FIG. 8, the finish curb block 400 is interposed between one main curb block 100 vertically cut along one of the plurality of partition walls 11 to be shortened in the connection direction with respect to the finish curb block 400 and another main curb block 100. Then, the male portion 410 is inserted into and coupled to the compartment 12 of the one main curb block 100 facing the male portion 410 such that the finish curb block 400 is connected to the one main curb block 100. Then, after one side wall of the finish curb block 400 is allowed to abut one side wall of another main curb block 100, the male tubular block 30 is inserted into and coupled to the female slot 20 of the other main curb block 100 and the female slot 420 of the finish curb block 400, which are adjacent to one another. In this way, one main curb block 100 having been cut can be connected to another main curb block 100 having not been cut.

As described above, the curb blocks according to the present invention can be arranged in a straight line, in a curved line, or in an inclined manner while being connected to one another through male-female coupling. In addition, a cut curb block can also be connected to an uncut curb block through male-female coupling.

Although the present invention has been described with reference to some embodiments in conjunction with the accompanying drawings, it should be understood that the foregoing embodiments are provided for illustration only and are not to be in any way construed as limiting the present invention, and that various modifications, changes, and alterations can be made by those skilled in the art without departing from the spirit and scope of the invention.

| <List of Reference Numerals> | |
|---|---|
| 100: main curb lock | 200: auxiliary curb block |
| 300: slanted curb block | 400: finish curb block |

What is claimed is:

1. A curb block system including:

one main curb block (100) formed through injection molding of a plastic material, a male tubular block (30) formed through injection molding of a plastic material, a finish curb block (400) formed through injection molding of a plastic material, and a second main curb block being cut to shorten the length of the second main curb block (100), the main curb block (100) comprising:

a hexahedral body case (10) having an open bottom and comprising a plurality of vertical partition walls (11) arranged at predetermined intervals in a longitudinal direction of the body case (10) inside the body case (10) to form a plurality of empty compartments (12);

stepped portions (40) formed at opposite ends of an upper surface (13) of the body case (10), respectively, and each having a smaller height than the upper surface (13); and semicircular female slots (20) vertically formed between the upper surface (13) and the stepped portions (40) to face in opposite directions, wherein the male tubular block (30) is sized and shaped to be coupled to the female slot (20) of the main curb block (100) and a semicircular female slot (420) of the finish curb block (400) and has a closed top and an open bottom, a circumferential portion of the male tubular block (30) has a thickness smaller than a width of the female slot (20) and a ceiling (31) of the male tubular block (30) has a thickness corresponding to a height difference between the stepped portion (40) and the upper surface (13), the plurality of vertical partition walls (11) are coupled at an upper end thereof to a ceiling of the body case (10), extend at a lower end thereof to above a lower end of the body case (10), and are integrally coupled at both sides thereof to front and rear walls of the body case (10), and the finish curb block (400) coupled to the second main curb block disposed on one side thereof and coupled to the male tubular block (30) together with the female slot (20) of the main curb block (100) disposed at the other side thereof, the finish curb block (400) comprising:

a male portion (410) having the same height as the stepped portion (40) of the main curb block (100), the male portion (410) being sized and shaped to be inserted into and coupled to one of the plurality of compartments (12) of the second main curb block through the open bottom of the second main curb block;

a stepped portion (440) having the same size and shape as the stepped portion (40) of the main curb block (100); and a reverse U-shaped connection portion (450) connecting the male portion (410) to the stepped portion (440) while allowing a semicircular female slot (420) to be formed between the male portion (410) and the stepped portion (440), the semicircular female slot (420) being identical to the semicircular female slot (20) of the main curb block (100), wherein an upper surface of the reverse U-shaped connection portion (450) is flush with the upper surface (13) of the main curb block (100).

* * * * *